US007262673B2

(12) United States Patent
Hesselbom

(10) Patent No.: US 7,262,673 B2
(45) Date of Patent: Aug. 28, 2007

(54) TRANSMISSION LINE

(75) Inventor: Hjalmar Hesselbom, Huddinge (SE)

(73) Assignee: Hesselbom Innovation & Development HB, Huddinge (SE)

( * ) Notice: Subject to any disclaimer, the term of this patent is extended or adjusted under 35 U.S.C. 154(b) by 94 days.

(21) Appl. No.: 10/477,599

(22) PCT Filed: May 15, 2002

(86) PCT No.: PCT/SE02/00933

§ 371 (c)(1),
(2), (4) Date: Jan. 23, 2004

(87) PCT Pub. No.: WO02/101871

PCT Pub. Date: Dec. 19, 2002

(65) Prior Publication Data

US 2004/0155726 A1 Aug. 12, 2004

(30) Foreign Application Priority Data

May 15, 2001 (SE) ..... 0101709

(51) Int. Cl.
*H01P 3/02* (2006.01)
*H01P 3/08* (2006.01)

(52) U.S. Cl. ..... 333/116; 333/238; 333/246

(58) Field of Classification Search ..... 333/1, 333/116, 161, 238, 246
See application file for complete search history.

(56) References Cited

U.S. PATENT DOCUMENTS 4,568,147 A 2/1986 Seymour et al. ..... 359/566
4,790,614 A 12/1988 Imoto et al. ..... 385/130
4,914,407 A * 4/1990 Itoh ..... 333/161
5,777,526 A 7/1998 Kawasaki ..... 333/1
5,796,317 A 8/1998 Bohlman et al. ..... 333/127
6,377,142 B1 * 4/2002 Chiu et al. ..... 333/238
6,483,403 B2 * 11/2002 Hirabayashi et al. ..... 333/204
6,879,289 B2 * 4/2005 Hayes ..... 343/700 MS

FOREIGN PATENT DOCUMENTS

EP 0343771 A1 3/1989
JP 7074506 3/1995

* cited by examiner

*Primary Examiner*—Dean Takaoka
(74) *Attorney, Agent, or Firm*—Nixon & Vanderhye P.C.

(57) ABSTRACT

A transmission line of striptype includes a dielectric having a local dielectric constant alternating between at least two different values. It can be manufactured by applying a first layer (3) of a material having a first dielectric constant ∈1 to a base (1), thereupon patterning the first layer to produce recesses, then applying a second layer (5) of a material having a second dielectric constant ∈2 over the first layer to at least completely fill the recesses to obtain a flat surface, and finally applying a conductor on top of the produced structure. The transmission line can be used for example for various types of filters and delay lines, is simple and has a low cost for its manufacture and can give a space-saving design of different components.

27 Claims, 7 Drawing Sheets fine structure alternative fine structure

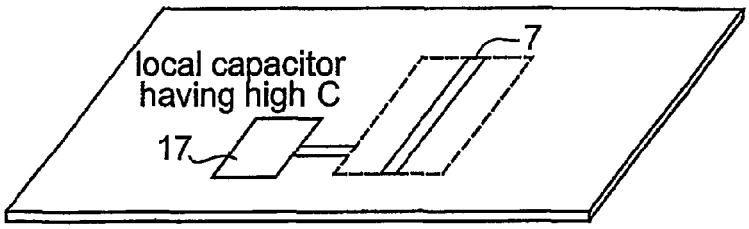
Fig. 17a
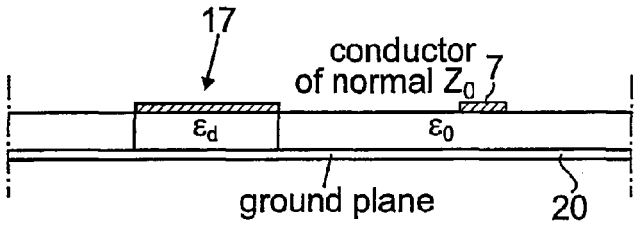
Fig. 17b
Fig. 13a
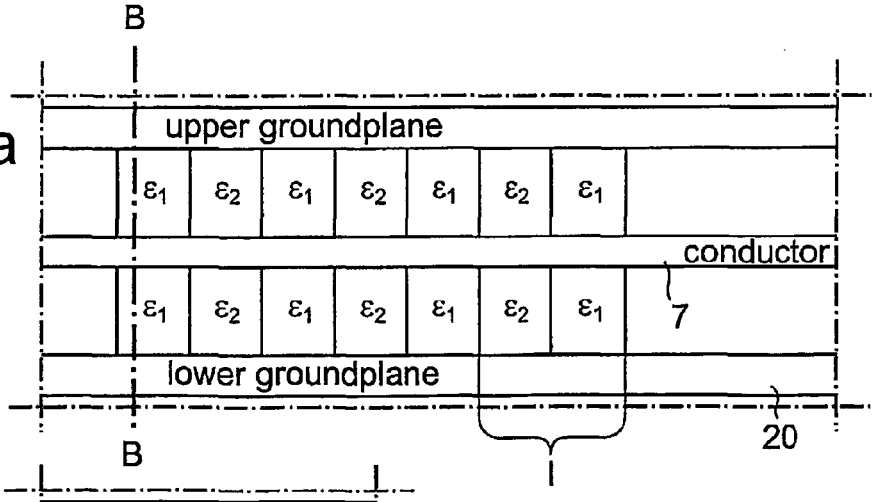
Fig. 13b
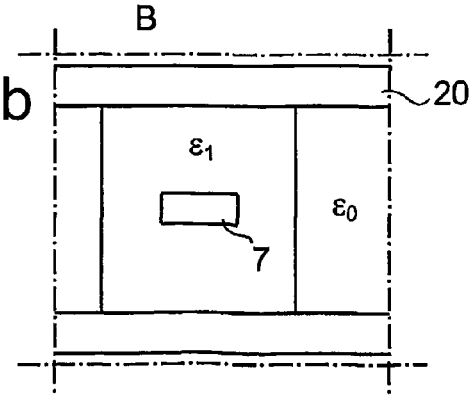

Bragg-filter
Bragg-filter
Bragg-filter
delay line
delay line
coupler
coupler
impedance matching
21a
21b
23a
23b
25a
25b
25c
29
$\varepsilon_2 > \varepsilon_1$

TRANSMISSION LINE

This application is the US national phase of international application PCT/SE02/00933 filed 15 May 2002, which designated the US. PCT/SE02/00933 claims priority to SE Application No. 0101709-4, filed 15 May 2001. The entire contents of these applications are incorporated herein by reference.

TECHNICAL FIELD

The present invention relates to transmission lines for high frequency electromagnetic signals, in particular transmission lines having different characteristics and components intended to be connected to, or form parts of, transmission lines.

BACKGROUND

For very high frequencies, electrical signal processing must partly be passively performed since signal processors are not available that in real time can execute all required operations. Some advanced signal processing can for example be executed in discrete components, for example SAW-components, or in some cases in microwave components that can be manually tuned. These components are more or less costly and/or require much space.

Furthermore, in fast electronic circuits it is often necessary to use delay lines to adapt the clock signal to the signal carrying information. It is conventionally produced by additional lengths of lines, i.e. by having the signal pass a line of extra large length, that often requires is much space on a circuit board and in addition complicates the layout of lines for connection to and between other components on the same circuit board.

It is generally true that it is desirable to select for a transmission line a dielectric having a low dielectric constant to obtain the least possible delay. However, in the case where one tries to accomplish couplers directly in a wire pattern, they could be made much smaller if it would be possible to produce a limited area having a higher dielectric constant at exactly the place where the coupler is located.

In many applications there is no problem associated with delay but instead problem can exist associated with the often high line density producing cross-talk between adjacent lines.

When accomplishing impedance adaptation for lines on commonly used substrates having a constant dielectric constant the widths of the strip shaped conductors used must be exponentially increasing when an adaptation to lower impedances is to be made. The widths of the conductors are often much large than the widths of the components to which the conductors are to be connected and thus the impedance adaptation is only virtual.

In the optical domain patterned variations of thickness have been used to produce Bragg filters, then using material grown in the height direction, and variations in refractive index to produce Bragg mirrors.

A method of producing Bragg mirrors in the electrical domain comprises stepwise changing the width of a conductor. It gives peculiar results since the configuration of the electromagnetic field does not directly adapt itself to different conductor widths.

In electrical systems a unique possibility exists to vary the signal velocity stepwise without obtaining reflections by varying at the same time the dielectric constant and the width of the conductors, maintaining the same characteristic impedance.

Variation of the electrical constant of a dielectric surrounding a conductor, or located at a conductor, has been proposed in U.S. Pat. No. 5,796,317 and the published Japanese patent application 7074506. In this Japanese patent application is disclosed how a filter in a transmission line can be produced by periodically changing, instead of designing the transmission line to have some periodically repeated wider portions, the dielectric constant of the material at the conductor path of the transmission line.

In the published European patent application 0 343 771 different methods are disclosed for producing waveguides using a porous, compressible dielectric material. In one embodiment a groove can be formed in a material which is filled with material of a higher dielectric constant.

SUMMARY OF THE INVENTION

It is an object of the invention to provide a structure of transmission lines that can give them increased performance or specific properties, for example filtering or signal delaying properties.

It is another object of the invention to provide a structure for transmission lines implying that components for the transmission lines can be produced in a space or area saving way.

In is another object of the invention to provide an efficient method of producing is transmission lines resulting in that more components can be integrated in the same circuit board, in particular in the same layer/level in the circuit board.

It is another object of the invention to provide an efficient method of producing transmission lines resulting in that components for the transmission lines can be designed in a space or area saving way.

Generally, the transmission lines as described herein that can be of the type stripline or microstrip comprise a dielectric having a local dielectric constant varying between at least two different values. The lines can be produced by applying a first layer of a material having a first dielectric constant on a substrate that can be conducting and/or a dielectric, and after that, patterning the first layer to produce recesses or grooves in this layer which can extend down to the substrate or/and at a distance thereof. Thus, upwards projecting portions of the material having the first dielectric constant are left. Then, a second layer of a material having a second dielectric constant is applied over the first layer so that the recesses or the grooves, i.e. the regions between the left portions, are at least totally filled. A substantially flat surface can then be obtained using a suitably selected materiel in the second layer and a suitable method of applying it. Finally, a stripshaped electric conductor is applied on top of the first and second layers.

Thus, the conductor should always be located at the material of the first and second layers and therefore also first a stripshaped conductor can be applied to the substrate so that it is located beneath the first and second layers. The substrate can in this case include regions that have the first and second dielectric constants. Then, the substrate can be a material that has been produced as described first above, with the conductor located on top of the layers.

The patterning can be executed so that portions of the first layer having parallel side surfaces or edges are left and therebetween recesses or grooves having parallel side surfaces or edges. Then, the structure consists of parallel stripshaped or rodshaped regions located at each other, having constant widths and heights and having a varying dielectric constant. Then, the conductor can be applied so that it passes substantially perpendicularly to the parallel edges of the recesses or grooves or perpendicularly to the longitudinally direction of the stripshaped or rodshaped regions. Furthermore, the patterning can be made so that a regularly periodical structure is obtained having left portions that are identical to each other and having recesses or grooves of the same width as each other A transmission line is usually designed for transmitting electromagnetic waves within a predetermined wavelength range and then the widths of the portions and recesses can be significantly smaller than the wavelengths within the predetermined wavelength range to produce a selected, effective dielectric constant. When using a periodic patterning having a regularly periodic structure thereby a dielectric can be obtained having an effective dielectric constant between the dielectric constant of the first layer and the dielectric constant of the second layer. The value of the effective dielectric constant is substantially determined by the ratio of the width of the left portions and the width of the recesses or grooves, i.e. of the widths of the stripshaped regions of the first and second layers, and in addition by the heights of the portions of the two layers, these heights however being substantially constant over all of the surface. Instead, if the width of adjacent ones of the left portions and the recesses have successively increasing or decreasing mathematical ratios when moving along the transmission line in one direction a transmission line having a maintained conductor width is obtained, the characteristic impedance thereof successively changing when moving in the same direction. It can be used for example when connecting to discrete components that require some characteristic impedance for an efficient connection. The patterning can be made only within one or more limited areas on the substrate to obtain one or more components, such as elements for delaying electric waves that propagates along the transmission line, couplers or filters. A simple, space saving method of manufacturing plural components on the same circuit board and in the same layer or level in the circuit board can thereby be obtained. The need for circuit area and for discrete components can thus be reduced.

For a periodic structure in which the widths of the left portions and the recesses are of the same magnitude of order as the wavelengths within the predetermined wavelength range Bragg filters can be obtained.

The transmission line can thus generally comprise a stripshaped electric conductor and regions located at the conductor which comprise dielectrics having different dielectric constants. The regions are stripshaped or rodshaped having a longitudinal direction substantially perpendicular to the longitude and direction of the conductor and have constant widths and heights, the widths taken in the longitudinal direction of the conductor. The widths can be significantly smaller than the wavelengths within the predetermined wavelength range. An electromagnetic wave propagating along the transmission line then experiences an effective dielectric constant that for each position along the line is determined by the dielectric constants of the regions located at each such position and by the relative dimensions of these regions, such as by the ratios of the widths and heights thereof. The regions can be located beneath and/or on top of the conductor. Ground planes can be located on the rear or distant sides of the regions.

Compared to a conventional layer structure the manufacturing method described herein implies that only one additional patterning step and one additional deposition step per dielectric layer that one desires to give a varying dielectric constant are required. In a normal, conventional processing sequence a new dielectric layer should be deposited after an underlying metal has been deposited and possibly patterned. In this dielectric layer then vias would be opened, a new metal deposited and then possibly patterned, etc. In the processing sequence described herein instead of the vias being opened in the deposited dielectric layer regions would be opened whereafter a new deposition of a planarizing material having a different dielectric constant would be made that would fill the opened regions in the first deposited dielectric layer. After this vias would be opened through the composite dielectric layer, a new metallizing would be made, etc. By using fine structures having varying dimension ratios for two materials having a high and a low dielectric constant respectively in which the local repetition distance is much smaller than the wavelengths, regions having all possible values of the dielectric constant in an interval between and including the dielectric constants of the two materials can be obtained in the same layer simultaneously in the same patterning and depositing procedure.

Additional objects and advantages of the invention will be set forth in the description which follows, and in part will be obvious from the description, or may be learned by practice of the invention. The objects and advantages of the invention may be realized and obtained by means of the methods, processes, instrumentalities and combinations particularly pointed out in the appended claims.

BRIEF DESCRIPTION OF THE DRAWINGS

While the novel features of the invention are set forth with particularly in the appended claims, a complete understanding of the invention, both as to organization and content, and of the above and other features thereof may be gained from and the invention will be better appreciated from a consideration of the following detailed description of non-limiting embodiments presented hereinbelow with reference to the accompanying drawings, in which:

FIG. 13*a* is a cross-sectional view of a conductor including a surrounding dielectric having an adapted dielectric constant along the conductor FIG. 13*b* is a cross-sectional view similar to FIG. 13*a* but taken perpendicularly to the conductor, in the section B-B, FIGS. 17*a* and 17*b* are a perspective view of a circuit board and a fragmentary sectional view thereof, respectively, illustrating a capacitor structure.

DETAILED DESCRIPTION

Figure 1:
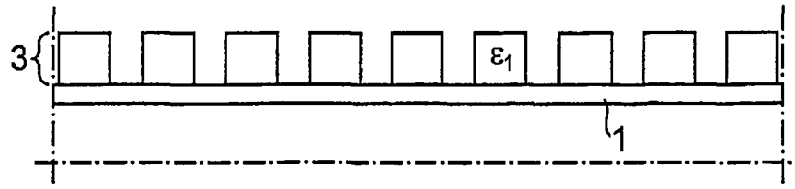
FIGS. 1-4 are cross-sectional views of part structures obtained after different steps in a method of manufacturing a dielectric structure having a dielectric constant that can be controlled in the manufacturing process.

Today many different methods of patterning deposited dielectric materials with a resolution down to or smaller than the line widths of the electrical conductors exist. In FIG. 1 a schematic cross-sectional view of a base or substrate 1 is shown, often a ground plane made from metal material, and a patterned layer 3 applied thereon having a first dielectric constant $\in_1$. The substrate 1 can for example be the top layer of an underlying multilayer structure, such as a metal layer constituting the top layer of a circuit board substrate. The layer 3 can be of for example homogenous material and have a substantially constant thickness before the patterning so that the remaining portions projecting upwards in the layer all have substantially the same height.

Today, also material having different dielectric constants exist that can be deposited by spinning, spraying or by a doctor blade and that have the property that they can fill an underlying structure and planarize the surface thereof, approximately as liquid floor levelling fillers, since they do not shrink significantly when being hardened. The result after such a depositing and hardening is seen in the cross-sectional view of FIG. 2 in which a layer 5 having a second dielectric constant $\in_2$ has been applied on top of the structured or patterned surface shown in FIG. 1 and gives a substantially flat surface. Also this layer can be of for example homogenous dielectric material and be applied so that the thicker portions thereof, that penetrate between the remaining portions of the first layer 3, have substantially the same height.

Figure 2:
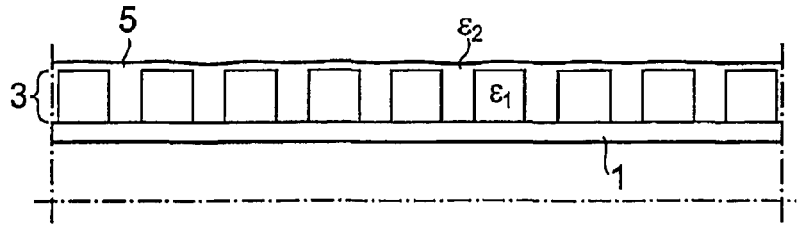
Figure 3:
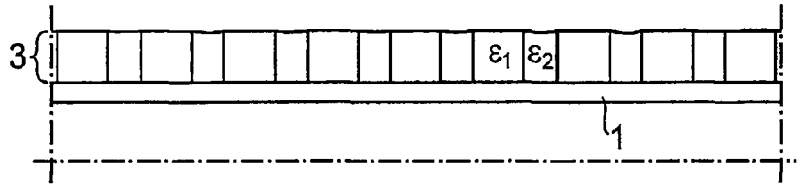
Figure 4:
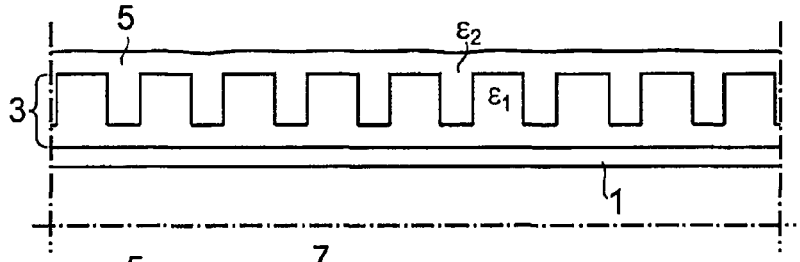

In this way, if the material of the patterned layer 3 and the material in the later applied layer 5 have different dielectric constants $\in_1$, $\in_2$ a substantially flat surface can be obtained having, taken laterally, along the surface of the substrate, a varying dielectric constant. If the material of the first layer 3 has been patterned down to the substrate 1 and the second material exactly covers the interspaces formed in the patterning, see FIG. 3, a variation of the dielectric constant is obtained that directly changes from the dielectric constant of the first material to that of the second material. If the material of the first patterned layer in the patterning process has not been fully removed down to the substrate and/or if the material of the second layer 5 is applied with such a thickness that it completely covers the material of the first layer 3, see. FIGS. 2 and 4, the resulting dielectric constant of the layers is determined by the local thickness and the heights of the material of the first layer and of the second layer. This resulting dielectric constant obtains a value between the dielectric constants of the materials of the first and second layers.

Figure 14:
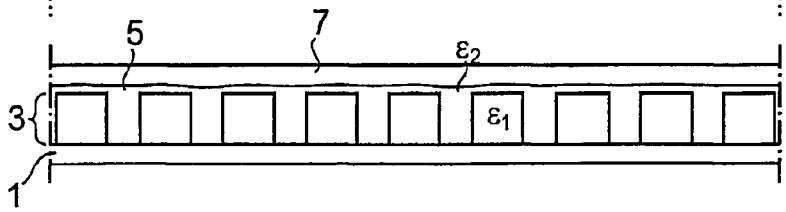
FIGS. 14 and 15 are cross-sectional views of a transmission line having a conductor applied on top of and beneath respectively a dielectric structure having a dielectric constant that can be controlled in manufacturing the structure.
Figure 15:
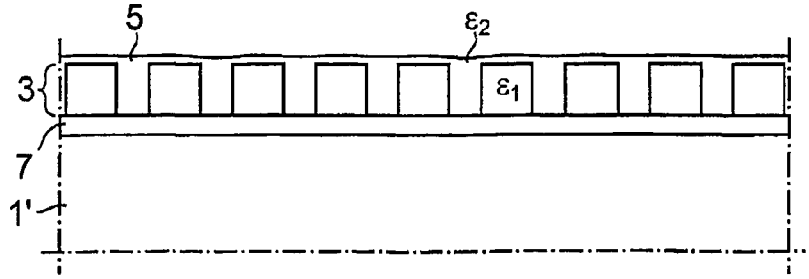

An electric conductor is applied at the dielectric layers 3, 5 either after or before the forming of these layers. In the former case a structure according to FIG. 14 is obtained. The electric conductor 7 can be obtained by first applying a conducting layer and thereafter patterning it such as by etching. In the latter case first a conductor 7 is applied to a substrate 1' of a dielectric material, see FIG. 15, such as by first applying a layer of electrically conducting material to the substrate and than patterning this conducting layer. On the free surface of the conductor and on the free surface of the substrate 1' a structure according to any of FIGS. 1-4 is then applied. In this case, the dielectric substrate 1' can also include a structure according to any of FIGS. 2-4 so that a conductor having an adapted dielectric constant both on top of and beneath the electric conductor 7 is obtained.

An effective dielectric constant $\in_{eff}$ can be defined as the dielectric constant that an electrical signal sees or experiences when propagating along the electric line 7 located at the dielectric layers 3, 5. The effective dielectric constant depends on the patterning according to the description above, i.e. primarily on the widths and the heights of the remaining portions of the layer 3 and of the portions of the layer 5 filled located therebetween and on the dielectric constants of the layers. The effective dielectric constant also depends on how the electric line 7 is located in relation to the patterning of the first dielectric layer. The patterning can for example be made so that from the first layer material is removed in grooves extending parallel to each other and having uniform and for example the same widths, as is indicated in FIGS. 1-4. The widths of the remaining portions and of the grooves therebetween can for example be of the same magnitude of order as the width of the conductor or significantly larger or smaller but is generally determined by the intended physical effect and thereby by the wavelengths $\lambda$ of the electric high frequency signal that is to propagate along the line 7, see the description hereinafter.

If the electric line passes along the patterning, i.e. parallel to the longitudinal direction of the remaining portions of the first layer 3 and of the portions therebetween, a signal propagating along the line experiences the resulting dielectric constant according to the description above of the layers beneath and/or on top of the conductor.

Figure 10:
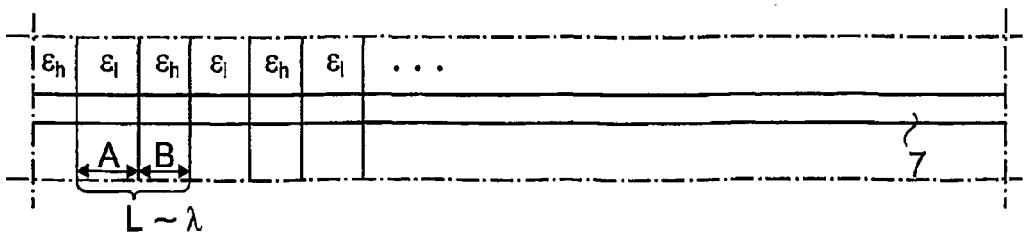
FIG. 10 is a cross-sectional view of a Bragg filter.

If the electric conductor 7 that is typically stripshaped having a constant width passes transversely in relation to the patterning, i.e. substantially perpendicularly to the parallel elongated regions having different, alternating dielectric constants, and the wavelength $\lambda$ of the signal is much larger than the characteristic dimension of the patterning, such as its repetition distance 1, the signal experiences an effective dielectric constant $\in_{eff}$ having a value between the electrical constants of the two layers, If the wavelength $\lambda$ of a signal propagating along the transmission line is of the same magnitude of order as, or is smaller than, the widths of the remaining patterned portions of the bottom layer 3 and of the interspaces therebetween, the signal experiences distinct, different dielectric constants. Then, if the line width of the conductor 7 is not varied to compensate it so that a constant characteristic impedance is obtained, reflections are produced at the transitions between regions having different dielectric constants. Such structures can for a selected wavelength and a selected patterning distance produce Bragg mirrors working as filters, see FIGS. 10 and 16. By varying the characteristic line widths A, B of the patterning of regions $8_l$, $8_h$ having dielectric constants $\in_l$, $\in_h$ specific filtering characteristics are obtained where thus A can be the uniform width of the regions $8_l$ having a dielectric constant $\in_l$ and B the width of the regions $8_h$ having a dielectric constant $\in_h$ and the repetition distance L in the uniformly or regularly repeated structure is $L=A+B\sim\lambda$. By the fact that the line widths A, B can be defined with a precision of the magnitude of order 1 μm which is high compared to typical signal wavelengths $\lambda$ of the magnitude of order 2 mm such as at the frequency 50 GHz, filters having very accurately defined characteristics can be obtained in a very simple and non-costly way.

Different filtering properties can thus be obtained by providing varying differences in dielectric constant or by a varying patterning distance. When designing circuits the materials can be given in advance and then different properties can be primarily obtained by varying the distances A and B for the case of an electric conductor perpendicular to the longitudinal direction of the elongated or stripshaped regions having different dielectric constants.

Each region having a width A and B with a dielectric constant $\in_l$ and $\in_h$, respectively, can be formed from periodically arranged regions having dielectric constants $\in_1$, $\in_2$ with a repetition distance 1 that is much smaller than the wavelength λ, see the description below of FIG. 16. Generally thus, regions which a signal experiences as distinct can have a periodic fine structure formed by part regions that are narrow or thin taken in the propagation direction of the signal and made from two materials having different dielectric constants, see the description below. The characteristic dimension of the fine structure in the propagation direction of the signal should he much smaller than the wavelength of the signal This characteristic dimension can be taken as the repetition distance of the fine structure, i.e. the sum l=a+b<<λ, where a and b are the widths of the part regions in the fine structure taken in the propagation direction. A first kind of region having a first dielectric constant can thus be formed from a fine structure having a first ratio of the widths a and b and a second kind of region having a second dielectric constant can be formed from another fine structure having a second different ratio of a and b. In this way, regions that are distinct as experienced by the signals and having each possible value of the dielectric constant within the closed interval between the first dielectric constant and the second dielectric constant can be obtained by using only two materials and by varying the ratio a:b.

Figure 5:
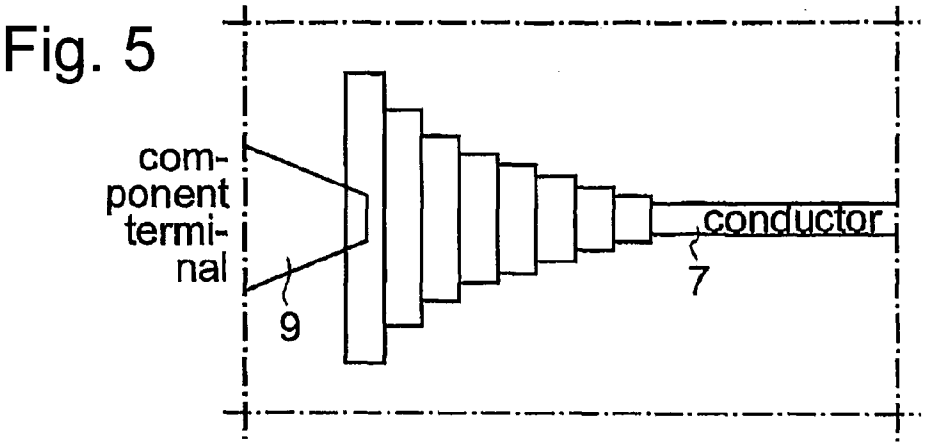
FIG. 5 is a plan view of a conductor comprising a segment for impedance adaptation according to prior art.
Figure 6A:
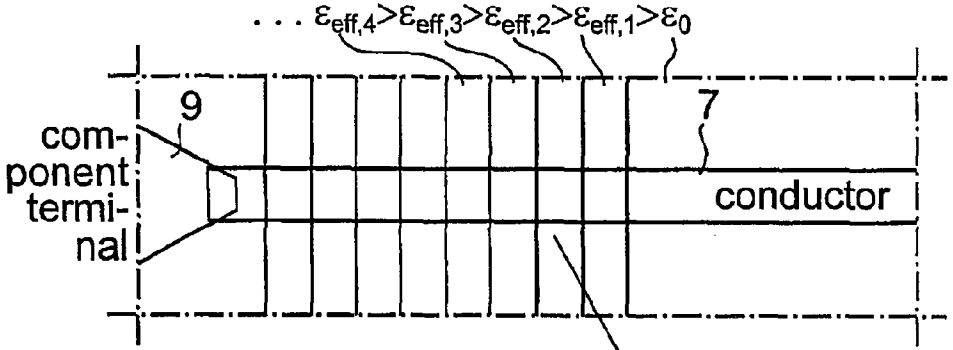
FIGS. 6*a*, 6*b* are plan views of a conductor having impedance adaptation obtained by varying the effective dielectric constant.
Figure 6B:
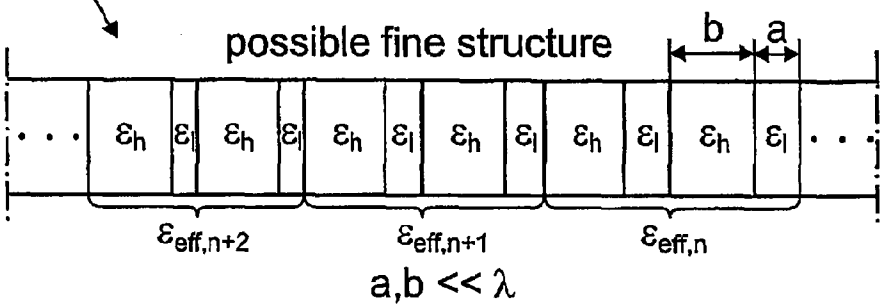

Impedance matching for electric lines is conventionally made by increasing the widths of the conductor continuously or stepwise, see FIG. 5. The characteristic impedance of a transmission line has generally a relationship according to $$Z \propto \ln\left(\frac{\text{conductor width}}{\text{thickness of dielectric}}\right) \cdot \sqrt{\varepsilon} \tag{1}$$

from which it appears that the width of the conductor must be varied significantly to change the impedance of the line. Then, the width of the conductor can often he larger than the width of the component terminal to which the conductor is to be connected so that the signal does not directly "fill" the terminal. Thereby the impedance matching can work badly by the fact that primarily reflections are produced. An impedance matching can instead be made by continuously or stepwise changing the dielectric constant, such as in the dielectric structure described above, by patterning the first dielectric material so that successively, for example increasing dielectric constants $\in_{eff,0}<\in_{eff,1}<\in_{eff,2}<\in_{eff,3}<\in_{eff,4}<\ldots$ are obtained without changing the width of the conductor, i.e. for a maintained, fixed or constant conductor width, see FIG. 6*a*. In this way the conductor can still have the same narrow width and correspond to the component that is to be connected, whereby the electric matching also really is good. Such a structure is shown in FIGS. 6*a* and 6*b* in which the stripshaped conductor 7 passes perpendicularly to the patterning of the bottom dielectric layer 3, i.e. perpendicularly to the longitudinal direction of the remaining parallel stripshaped portions of the first layer and of the parallel interspaces located therebetween and filled with second layer. The widths of the parallel portions and the interspaces therebetween are significantly smaller than the wavelength λ of the signal.

A successively increasing or decreasing effective dielectric constant $\in_{eff,0}<\in_{eff,1}<\in_{eff,2}<\in_{eff,3}<\in_{eff,4}<\ldots$ can then be obtained by successively changing the ratio of the then be obtained by successively changing the ratio of the widths a, b of the regions having dielectric constants $\in_1$ and $\in_2$, where $\in_1<\in_2$, in the direction towards the terminal 9, see in particular FIG. 6*b*. In the case of an increasing dielectric constant thus the ratio a:b should then successively decrease when approaching the terminal. As is illustrated, the region having a dielectric constant $\in_{eff,n}$ has a smaller ratio a:b than the adjacent region having an effective dielectric constant $\in_{eff,n+1}$. The width of the conductor 7 is constant and can be better adapted to the component terminal so that undesired reflections can be reduced.

Figure 7A:
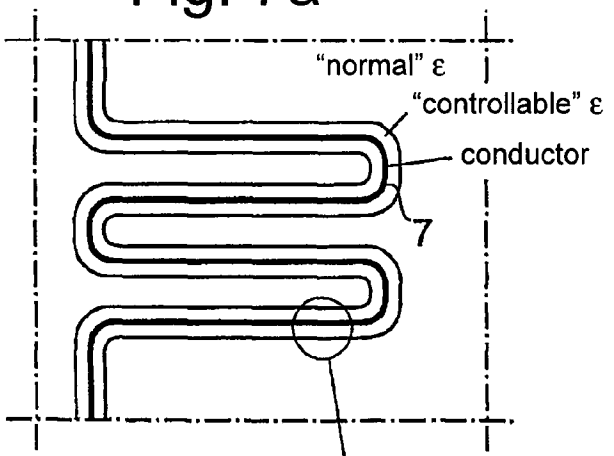
FIG. 7*a* is a plan view of a delay line.
Figure 7B:
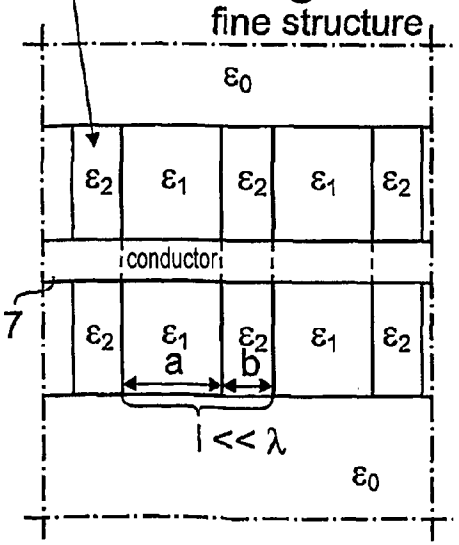
FIGS. 7*b*, 7*c* are cross-sectional views of the region at a delay line.
Figure 7C:
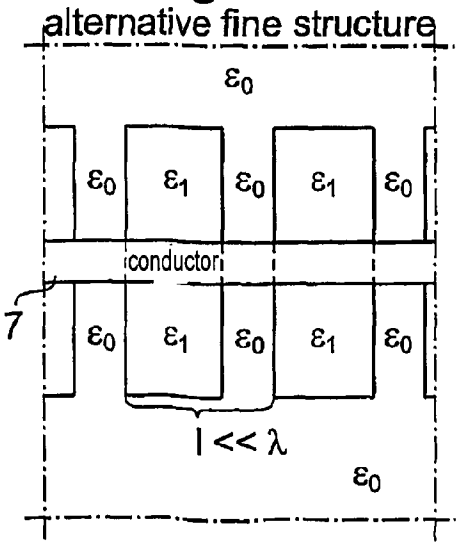

A conductor intended for delaying a signal can instead of being made longer be located on a dielectric produced according to the description above having an adapted higher effective dielectric constant $\in_{eff}$. Such a delay line is shown in FIGS. 7*a*, 7*b* and 7*c*. The patterning is also here made perpendicularly to the longitudinal direction of the line 7 and the period distance 1 of the patterning is significantly smaller than the signal wavelength ),. As is shown in FIGS. 7*b* and 7*c* dielectric regions having adapted or controlled effective dielectric constants can be located both beneath and on top of the stripshaped conductor, having a corresponding patterning and effective dielectric constants both on top of and beneath the conductor. Such a structure including regions on top of and beneath the line and having adapted dielectric constants can be generally used when required or suitable. As is shown in FIG. 7*b* the conductor 7 and the narrow transverse regions having special dielectric constants $\in_1$ and $\in_2$ for obtaining a selected effective dielectric constant $\in_{eff}$ can be located in a base material having the dielectric constant $\in_0$, but the base material can also form one type of the regions, as is shown in FIG. 7*c*.

Figure 8:
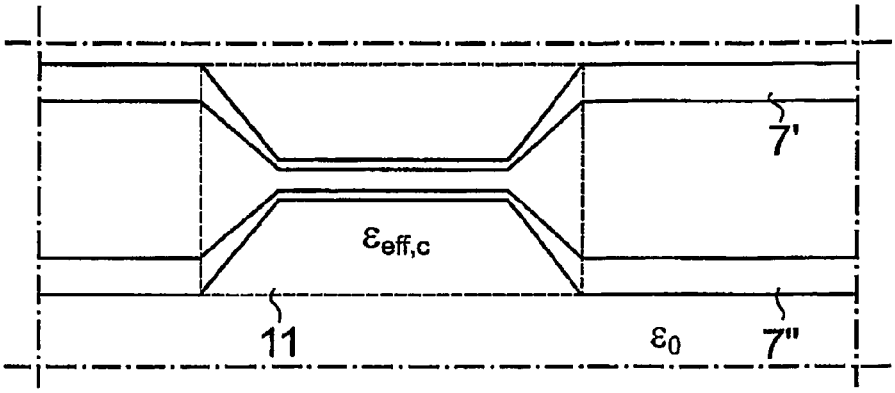
FIG. 8 is a plan view of a coupler constructed on a small area.

A region for a coupler on a circuit board can be designed to have a higher dielectric constant using the dielectric pattern structure described above and thereby the coupler can be given smaller dimensions, see FIG. 8. Two conductors 7', 7" pass within a coupling area 11 parallel to and at a small distance of each other. They are normally located in material having a dielectric constant $\in_0$ but within the coupling area the material located at the lines has an effective dielectric constant $\in_{eff,c}$, that can be obtained using a patterning according to the description above using narrow, parallel strips having widths a,b<λ made from materials having for example dielectric constants $\in_0$ and $\in_1$, compare FIG. 7*c*, or having dielectric constants $\in_1$ and $\in_2$, compare FIG. 7*b*.

Figure 9:
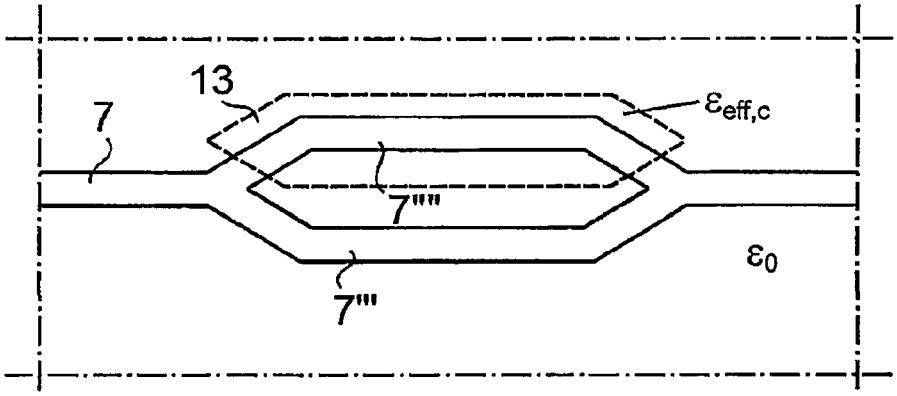
FIG. 9 is a plan view of a filter structure having two branches.

Filter functions can also be obtained by dividing a signal to propagate along conductors having correct characteristic impedance but having different wave propagation velocities to then be added, see FIG. 9. The signal that arrives along a conductor 7 is divided to propagate along two parallel lines 7''' and 7'''' located at dielectric materials having different effective dielectric constants $\in_0$, that for example can be the dielectric constant of the base material, and $\in_{eff,f}$, that is obtained by the fact that in an area 13 around the conductor 7'''' a structure is provided having thin stripshaped regions of alternatingly different dielectric constants, see FIGS. 7*b* and 7*c*. The signals from the two paths 7''' and 7'''' are then combined and have then obtained a time offset in relation to each other.

Figure 11:
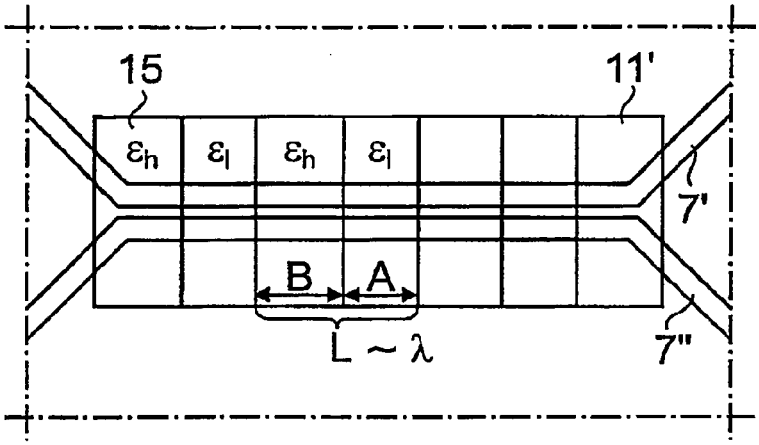
FIG. 11 is a plan view of a coupler including a Bragg filter.

A coupler can be combined with Bragg filtering to give a controlled Q-factor, see FIG. 11. In a region 11', within which the conductors 7', 7'' pass relatively close to and parallel to each other a structure is provided according to the description above having regions 15 of widths A, B and dielectric constants $\in_l$, $\in_h$ with a patterning distance L of the same magnitude of order as the signal wavelength λ. At least the regions that have one of these dielectric constants can be formed by a periodic fine structure according to the description above including narrow part regions having alternating dielectric constants $\in_1$, $\in_2$.

Figure 12:
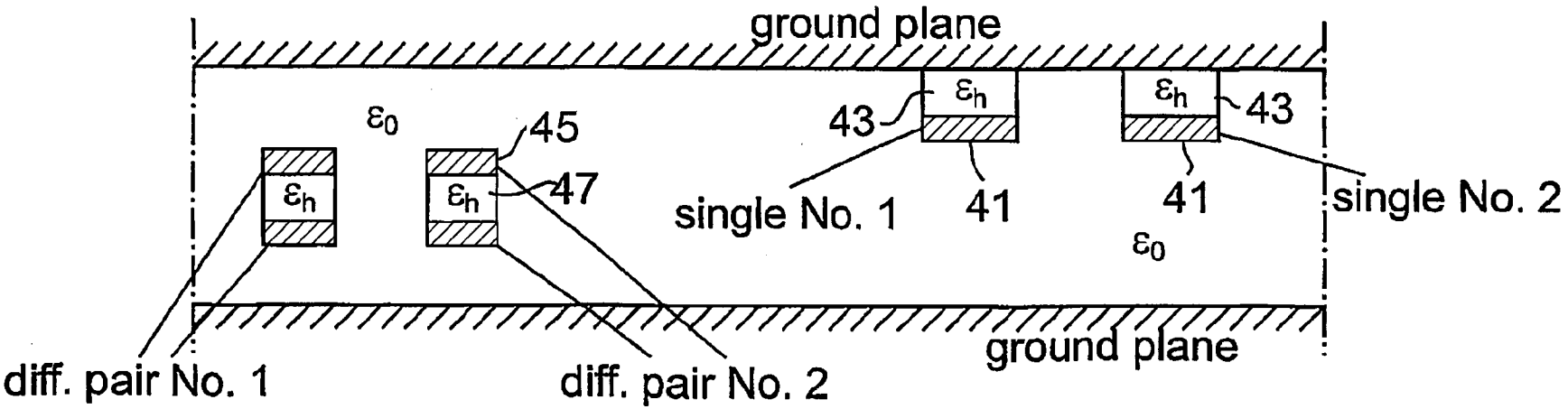
FIG. 12 is a cross-sectional view of a conductor structure having improved characteristics.

Parallel conductors 41 on or in a circuit board can he more densely arranged for the same level of cross-talk by the fact that the dielectric material in regions 43 straightly beneath and/or on top of the conductors have a higher dielectric constant $\in_h$ than the material between the lines having a normal dielectric constant $\in_0$, see FIG. 12, The electromagnetic field is concentrated in the regions having the high dielectric constant $\in_h$ and is lower in the surrounding material having a normal dielectric constant $\in_0$. The regions 43 having a higher dielectric constant at ones of the conductors are here located at a distance of the regions 43 having a higher dielectric constant at the other conductor, such as that the regions, seen laterally from the longitudinal direction of the conductors, only extend over the widths of the lines 41. Alternatively the same design can of course be used to reduce the cross-talk for instead a maintained conductor density. The parallel lines can here also be arranged in different layers on top of each other, see the conductors 45 in FIG. 12. Then, between the lines a region 47 can be provided having a higher dielectric constant $\in_h$ which laterally only extends over the widths of the conductors. A combination of these structures is seen at the left in FIG. 12 including two differential pair conductors. The regions having the higher dielectric constant $\in_h$ can in all these embodiments be formed by a periodic fine structure according to the description above, compare in particular FIGS. 7*b* and 7*c*.

Fine structure, having a selected value of their dielectric constants can also be used to form dielectric capacitors, see FIGS. 17*a* and 17*b*. In these figures is shown that beneath an electrically conducting capacity plate 17 made in the same layer as the conductor 7 that is located on top of dielectric having a normal dielectric constant $\in_0$ and a normal characteristic impedance $Z_0$, an area 19 is provided having a dielectric constant $\in_d$. A ground plane 20 is located on the opposite side, on the bottom side, of the region 19. The region 19 can be made from narrow regions according to the description above having alternating dielectric constants $\in_0$ and $\in_1$ or $\in_1$ and $\in_2$, compare FIGS. 7*b* and 7*c*.

In the embodiments described above a conductor 7 can be applied so that it obtains dielectric material having an adapted or changing dielectric constant according to the description above either only at one of its sides including a ground plane 20, or including such dielectric material both beneath and on top of the conductor, see FIGS. 13*a*, 13*b*, including two ground planes, one plane on top of and one plane beneath the conductor. In the former case a transmission line of the type strip line is obtained and in the latter case a conductor of the type microstrip.

Figures 16A, 16B, 16C, 16D, 16E:
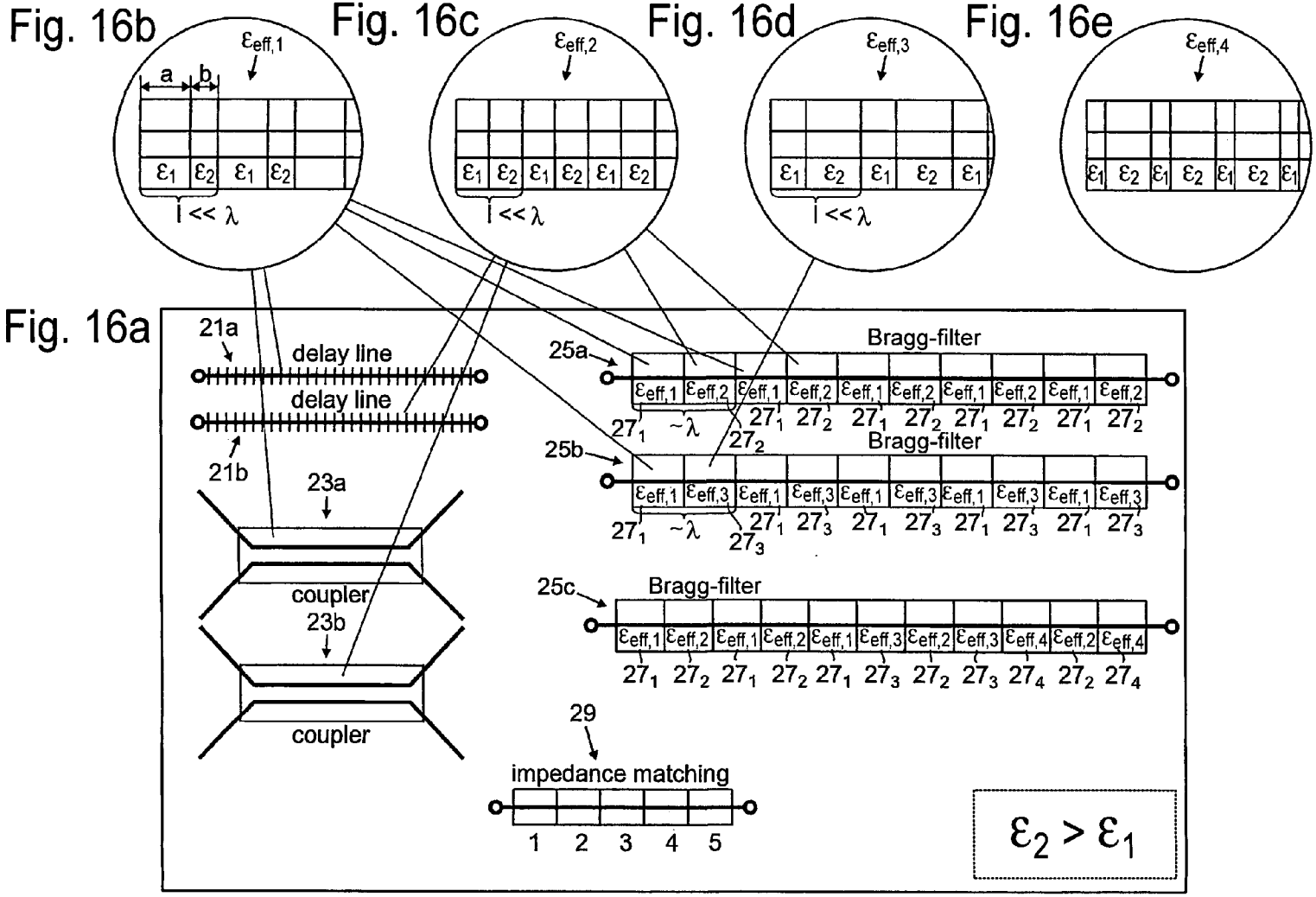
FIG. 16 is a view from above of a circuit board having several different components based on transmission lines.

In FIG. 16*a* a circuit board is schematically shown as seen from the top side including several different components. At 21*a*, 21*b* two delay lines having the same length but different delays are provided. Examples of cross-sections of the structure along their electric conductors are shown in FIGS. 16*b* and 16*c*, from which it appears that the structure in the two cases is periodic but that the ratio a:b is different for the regions having dielectric constants $\in_1$ and $\in_2$, where for example $\in_1<\in_2$. At 23*a*, 23*b* couplers are provided having electric conductors of a geometric configuration identical to each other but having different characteristics which are obtained by the fact that the material at the lines in the coupling area has different effective dielectric constants. Examples of cross-sections of the structures at the lines here also appear from FIGS. 16*b* and 16*c*. Two Bragg filters 25*a*, 25*b* have configurations that are identical to each other and include regions $\mathbf{27}_1\mathbf{1}$, $\mathbf{27}_2$ and $\mathbf{27}_1$, $\mathbf{27}_3$, respectively, having different effective dielectric constants $\in_{eff,1}$, $\in_{eff,2}$ and $\in_{eff,1}$, $\in_{eff,3}$, respectively. The structure in the regions can be as schematically appears from FIGS. 16*a*, 16*b* and 16*c*, respectively. The Bragg filters obtains, due to the different effective dielectric constants, different reflection coefficients. At 25*c* a Bragg filter is shown having varying $Z_0$ differences that contains regions $\mathbf{27}_1$, $\mathbf{27}_2$, $\mathbf{27}_3$, $\mathbf{27}_4$ having four different effective dielectric constants $\in_{eff,1}$, $\in_{eff,2}$, $\in_{eff,3}$, $\in_{eff,4}$. The fine structure of the regions can be as shown in FIGS. 16*b*, 16*c*, 16*d* and 16*e*. At 29 a segment of a transmission line having impedance matching is illustrated.

Having two suitable materials available which are suited for patterning and for filling including planarizing respectively and which have different dielectric constants 61 $<\in_2$, using the manufacturing method described above, regions having all effective dielectric constants within the interval $[\in_1,\in_2]$ can be simultaneously produced by only varying the ratio a:b as long as the patterning can be made much smaller than the wavelength λ of the electromagnetic waves for which the structures are intended. A plurality of components of different kinds can be produced in some layer or level.

The manufacturing method described above and the structures described above are well suited to be combined with manufacturing circuit boards having a plurality of different layers. Using the structures, in many cases discrete components can be avoided and the structures are generally compact and require a minimum share of the available surface of a circuit board.

While specific embodiments of the invention have been illustrated and described herein, it is realized that numerous additional advantages, modifications and changes will readily occur to those skilled in the art. Therefore, the invention in its broader aspects is not limited to the specific details, representative devices and illustrated examples shown and described herein. Accordingly, various modifications may be made without departing from the spirit or scope of the general inventive concept as defined by the appended claims and their equivalents. It is therefore to be understood that the appended claims are intended to cover all such modifications and changes as fall within a true spirit and scope of the invention.

The invention claimed is:

1. A method of manufacturing a transmission line of strip type intended for transmitting electric magnetic waves within a predetermined wavelength range, the method comprising the steps:

applying a first layer of a material having a first dielectric constant to a substrate, thereafter patterning the first layer to produce portions remaining of the first layer and therebetween recesses or grooves in the first layer, the patterning made so that the widths of the remaining portions and of the recesses or grooves taken in a first direction are significantly smaller than wavelengths within the predetermined wavelength range, thereafter applying a second layer of a material having a second dielectric constant on top of the first layer to fill the recesses or grooves to produce a substantially flat surface, and applying, along said first direction, a stripshaped electric conductor on top of the substantially flat surface.

2. The method of claim 1, wherein the patterning is made so that the remaining portions have parallel lateral surfaces or edges and the recesses or grooves have parallel lateral surfaces or edges.

3. The method of claim 2, wherein the patterning is made so the distances between the parallel lateral surfaces or edges of the remaining portions and of the recesses or grooves are significantly smaller than the wavelengths within the predetermined wavelength range.

4. The method of claim 2, wherein the patterning and/or the applying of the stripshaped electric conductor is made so that the parallel lateral surfaces or edges of the remaining portions and of the recesses or grooves are substantially perpendicular to said first direction.

5. The method of claim 1, wherein the patterning is made so that a regularly periodic structure is obtained including remaining portions having widths identical to each other and recesses or grooves having widths identical to each other.

6. The method of claim 1, wherein the patterning is made so that adjacent remaining portions and recesses or grooves have successively increasing or decreasing mathematical ratios of their widths when moving along the transmission line in said first direction, the characteristic impedance of the transmission line thereby successively changing when moving in the first direction.

7. The method of claim 1, wherein the patterning is made only within one or more limited areas on the substrate to obtain one or more components, including elements for delaying electromagnetic waves propagating along the transmission line, couplers or filters.

8. The method of claim 1, wherein, in the step of applying a first layer of a material having a first dielectric constant, the first layer is applied to an electrically conducting layer.

9. The method of claim 1, wherein, in the step of applying a stripshaped electric conductor to a substrate, the stripshaped electric conductor is applied to substrate being a structure including regions of the material having the first dielectric constant and regions of the material having the second dielectric constant, the regions having shapes and positions corresponding to those of the remaining portions and of the recesses or grooves which are later formed.

10. A method of manufacturing a transmission line of strip type intended for transmitting electric magnetic waves within a predetermined wavelength range, the method comprising the steps:

applying, along a first direction, a stripshaped electric conductor to a substrate, thereafter applying a first layer of a material having a first dielectric constant on top of the stripshaped electric conductor, thereafter patterning the first layer to produce portions remaining of the first layer and therebetween recesses or grooves in the first layer, the patterning made so that the widths of the portions and of the recesses or grooves taken in said first direction are significantly smaller than wavelengths within the predetermined wavelength range, and thereafter applying a second layer of a material having a second dielectric constant on top of the first layer to fill the recesses or grooves to produce a substantially flat surface.

11. The method of claim 10, wherein the patterning is made so that the remaining portions have parallel lateral surfaces or edges and the recesses or grooves have parallel lateral surfaces or edges.

12. The method of claim 11, wherein the patterning is made so the distances between the parallel lateral surfaces or edges of the remaining portions and of the recesses or grooves are significantly smaller than the wavelengths within the predetermined wavelength range.

13. The method of claim 11, wherein the patterning and/or the applying of the stripshaped electric conductor is made so that the parallel lateral surfaces or edges of the remaining portions and of the recesses or grooves are substantially perpendicular to said first direction.

14. The method of claim 10, wherein the patterning is made so that a regularly periodic structure is obtained including remaining portions having widths identical to each other and recesses or grooves having widths identical to each other.

15. The method of claim 10, wherein the patterning is made so that adjacent remaining portions and recesses or grooves have successively increasing or decreasing mathematical ratios of their widths when moving along the transmission line in said first direction, the characteristic impedance of the transmission line thereby successively changing when moving in the first direction.

16. The method of claim 10, wherein the patterning is made only within one or more limited areas on the substrate to obtain one or more components, including elements for delaying electromagnetic waves propagating along the transmission line, couplers or filters.

17. The method of claim 10, wherein, after the step of applying a second layer of a material having a second dielectric constant, a layer of an electrically conducting material is applied to the substantially flat surface.

18. A method of manufacturing a transmission line of strip type intended for transmitting electric magnetic waves within a predetermined wavelength range, the method comprising the steps:

applying a first layer of a material having a first dielectric constant to a substrate, thereafter patterning the first layer to produce portions having parallel lateral surfaces or edges remaining of the first layer and therebetween recesses or grooves in the first layer having parallel lateral surfaces or edges, the patterning made to produce a regularly periodic structure including remaining portions having widths identical to each other and recesses or grooves having widths identical to each other, the distances between the lateral surfaces or edges of the remaining portions and of the recesses or grooves, taken in a first direction, being significantly smaller than wavelengths within the predetermined wavelength range, thereafter applying a second layer of a material having a second dielectric constant on top of the first layer to fill the recesses to produce a substantially flat surface, so that a dielectric is obtained including the first and the second layers having an effective dielectric constant between the dielectric constant of the first layer and the dielectric constant of the second layer, the effective dielectric constant having a value determined by substantially the ratio of the widths of the remaining portions and the widths of the recesses or grooves, and applying, along said first direction, a stripshaped electric conductor on top of the substantially flat surface to extend substantially perpendicularly to the parallel lateral surfaces or edges of the recesses or grooves.

19. A method of manufacturing a transmission line of strip type intended for transmitting electric magnetic waves within a predetermined wavelength range, the method comprising the steps:

applying, along a first direction, a stripshaped electric conductor to a substrate, thereafter applying a first layer of a material having a first dielectric constant on top of the stripshaped electric conductor, thereafter patterning the first layer to produce portions having parallel lateral surfaces or edges remaining of the first layer and therebetween recesses or grooves in the first layer having parallel lateral surfaces or edges, the patterning made so that the stripshaped conductor extends substantially perpendicularly to the parallel lateral surfaces or edges of the recesses or grooves and so that a regularly periodic structure is produced including remaining portions having widths identical to each other and recesses or grooves having widths identical to each other, the distances between the laterals surfaces or edges of the remaining portions and of the recesses or grooves, taken in said first direction, being significantly smaller than the wavelengths within the predetermined wavelength range, and thereafter applying a second layer of a material having a second dielectric constant on top of the first layer to fill the recesses or grooves to produce a substantially flat surface so that a dielectric is obtained including the first and the second layers having an effective dielectric constant between the dielectric constant of the first layer and the dielectric constant of the second layer, the effective dielectric constant having a value determined by substantially the ratio of said distances between the laterals surfaces or edges of the remaining portions and said distances between the laterals surfaces or edges of the recesses or grooves.

20. A method of manufacturing a transmission line of strip type acting as a filter for electric magnetic waves within a predetermined wavelength range, the method comprising the steps:

applying a first layer of a material having a first dielectric constant to a substrate, thereafter patterning the first layer to produce portions having parallel lateral surfaces or edges remaining of the first layer and therebetween recesses or grooves in the first layer having parallel lateral surfaces or edges, the patterning made so that the widths of the remaining portions and of the recesses or grooves are of the same magnitude of order as the wavelengths within the predetermined wavelength range, thereafter applying a second layer of a material having a second dielectric constant on top of the first layer to fill the recesses or grooves to produce a substantially flat surface, and applying a stripshaped electric conductor on top of the substantially flat surface to extend substantially perpendicularly to the parallel edges of the recesses or grooves.

21. The method of claim 20, wherein, in the step of patterning the first layer, the patterning is made to produce a regularly periodic structure including remaining portions having widths identical to each other and recesses or grooves having widths identical to each other.

22. A method of manufacturing a transmission line of strip type acting as a filter for electric magnetic waves within a predetermined wavelength range, the method comprising the steps:

applying a stripshaped electric conductor to a substrate, thereafter applying a first layer of a material having a first dielectric constant on top of the stripshaped electric conductor, thereafter patterning the first layer to produce portions having parallel lateral surfaces or edges remaining of the first layer and therebetween recesses or grooves in the first layer having parallel lateral surfaces or edges, the patterning made so that the stripshaped electric conductor extends substantially perpendicularly to the parallel edges of the recesses or grooves and so that the widths of the remaining portions and of the recesses or grooves are of the same magnitude of order as the wavelengths within the predetermined wavelength range, and thereafter applying a second layer of a material having a second dielectric constant on top of the first layer to fill the recesses or grooves to produce a substantially flat surface.

23. The method of claim 22, wherein, in the step of patterning the first layer, the patterning is made to produce a regularly periodic structure including remaining portions having widths identical to each other and recesses or grooves having widths identical to each other.

24. A coupler of electromagnetic waves including two stripshaped electric conductors along which the electromagnetic waves propagate, the stripshaped electric conductors being located at dielectric material and passing parallel to each other and at a relatively small distance of each other, wherein the dielectric material at the stripshaped electric conductors comprises regions, each of which having a dielectric constant selected among at least two dielectric constants, the regions provided to have dielectric constants changing in one direction along the stripshaped electric conductors to provide filtering of electromagnetic waves arriving on one of the two stripshaped electric conductors, so that from the two stripshaped electric conductors in the coupler filtered electromagnetic waves are provided.

25. The coupler of claim 24, wherein the regions are rectangular, each of the regions having two opposite sides substantially perpendicular to the longitudinal direction of the stripshaped electric conductors.

26. The coupler of claim 24, wherein the regions are stripshaped having their longitudinal direction substantially perpendicular to the longitudinal direction of the stripshaped electric conductors.

27. The coupler of claim 24 for coupling electromagnetic waves within a predetermined wavelength range wherein at least the regions that have one of the at least two dielectric constants include part regions, the part regions of each of the regions that have said one of the at least two dielectric constants having constant widths and heights, the widths taken in the longitudinal direction of the stripshaped electric conductors and being significantly smaller than the wavelengths within the predetermined wavelength range.

* * * * *